US006229874B1

(12) United States Patent
Sakabe et al.

(10) Patent No.: US 6,229,874 B1
(45) Date of Patent: May 8, 2001

(54) MONOCHROMATOR AND METHOD OF MANUFACTURING THE SAME

(75) Inventors: Noriyoshi Sakabe; Nobuhisa Watanabe, both of Tsukuba (JP)

(73) Assignee: The University of Tsukuka, Tsukuba (JP)

( * ) Notice: Subject to any disclaimer, the term of this patent is extended or adjusted under 35 U.S.C. 154(b) by 0 days.

(21) Appl. No.: 09/439,283

(22) Filed: Nov. 15, 1999

(30) Foreign Application Priority Data

Nov. 16, 1998 (JP) ..... 10-325189

(51) Int. Cl.[7] ..... G21K 1/06
(52) U.S. Cl. ..... 378/84; 378/145
(58) Field of Search ..... 378/84, 145

(56) References Cited

U.S. PATENT DOCUMENTS 5,004,319 * 4/1991 Smither ..... 378/84
5,923,720 * 7/1999 Barton et al. ..... 378/84

* cited by examiner

*Primary Examiner*—Robert H. Kim
*Assistant Examiner*—Phuong Le
(74) *Attorney, Agent, or Firm*—Stevens, Davis, Miller & Mosher, LLP

(57) ABSTRACT

A base member obtained by cutting a cylindrical body having a center axial line at a maximum asymmetric angle $\alpha_0$ with respect to a plane orthogonal to the center axial line of cylindrical body is prepared. Next, the thus obtained ellipsoidal asymmetric cut surface of the base member is shaped along a peripheral surface of an imaginary cylindrical body having a radius $R_0$, into an asymmetric cut curved-surface. Then, a monochromator Si crystal is bonded to the asymmetric cut curved-surface of the base member. Both the asymmetric angle and the radius of curvature for a desired wavelength within a wide wavelength range can be simultaneously tuned only by the $\phi$-axis rotation.

8 Claims, 8 Drawing Sheets

MONOCHROMATOR AND METHOD OF MANUFACTURING THE SAME

BACKGROUND OF THE INVENTION

1. Field of the Invention

The present invention relates to an X-ray monochromator with simultaneous tuning of an asymmetric angle-and-radius of curvature, and more particularly relates to a single crystal X-ray monochromator which has a high focusing capability and a wide wavelength range from 1 Å to 2 Å.

2. Related Art Statement

In these days, X-ray monochromators which are capable of selecting an arbitrary wavelength have become important due to the development of radiation light, and many developments for X-ray monochromators have been proposed. Recently a two-crystal monochromator and an asymmetric cut triangle monochromator (curved asymmetric triangle crystal spectroscopes) have been practically used. The two-crystal monochromator is remarkably convenient for use, because an exit X-ray direction is invariant for whichever wavelength. However, it has a disadvantage that the focusing capability is too low to exhibit the high intensity. Therefore, the asymmetric cut triangle bent monochromators have been used for many beamlines for protein crystallography which utilizes beamline BL6A from a bending electromagnet BL6A installed in the Photon Factory in Tsukuba, Ibaraki, Japan.

The asymmetric cut triangle bent monochromator has an advantage in realizing high intensity, with placed expectation for its application to various X-ray analyses. However, in this type of monochromators, the demagnification rate of a beam passing through the asymmetric cut crystal monochromator depends on the angle between the beam and the crystal surface with the asymmetry factor, which is then related to the wavelength. Therefore, the demagnification rate depends on the wavelength, and thus a usable wavelength range is narrow. For this reason, about ten kinds of different asymmetric cut crystals are required in order to generate X-rays of wavelengths ranging from 1 Å to 2 Å. In order to perform the beam demagnification and focusing over a wide range of wavelengths, several different asymmetric cut spectral crystals have to be prepared, and any desired one of them has to be used for respective wavelengths. Therefore, when a measurement using various wavelengths, e.g. a measurement using the abnormal dispersion effectively, is to be conducted, a very long time is required for replacing spectral crystals, and such a long time could not be practically accepted.

Further, the use of a strong X-ray source such as emitted light makes it difficult to cool the conventional asymmetric cut triangle monochromator, which unexpectedly provides a problem related to heat load. In particular, it is pointed out that the intensity of the emitted X-rays varies due to the heat load with the lapse of time, although the crystal does not melt due to the heat.

SUMMARY OF THE INVENTION

It is therefore an object of the present invention to provide an X-ray monochromator, which is capable of effectively generating monochromatic X-rays having high intensity and covering a wide range of wavelengths by using only one monochromator crystal.

In order to attain such an object, according to the present invention, a monochromator comprises:

a base member having an asymmetric cut curved-surface obtained by cutting a cylindrical body at a maximum asymmetric angle $\alpha_0$ with respect to a plane orthogonal to a center axial line of the cylindrical body to obtain an ellipsoidal asymmetric cut surface, and then curving the thus obtained ellipsoidal asymmetric cut surface; and a monochromator crystal bonded to said asymmetric cut curved-surface of the base member;

wherein said asymmetric cut curved-surface of the base member is shaped along a peripheral surface of an imaginary cylindrical body having a radius $R_0$, and an asymmetric angle and a radius of curvature for a desired wavelength are simultaneously tuned by rotating said base member around a center axial line thereof.

In the monochromator according to the present invention, both the asymmetric angle and radius of curvature can be simultaneously tuned over a wide wavelength range only by rotating the base member around the center axial line ($\phi$-axis) thereof.

In a preferable embodiment of the monochromator according to the invention, the base member serving as a pedestal is provided with cooling means for preventing an undesired excessive temperature rise of the monochromator. Therefore, a variation in a beam intensity can be suppressed during the measurement.

Preferably, the center axial line of the imaginary cylindrical body intersects with the center axial line of the base member, and makes an angle of 90°-$\beta$ with respect to a major axis of the ellipsoidal asymmetric cut surface where $\beta$ is an offset angle ranging from 0 to 90° viewed from the above in a direction of the center axial line of the base member.

Further preferably, the angle $\beta$ is approximately 20.9°.

Also preferably, the maximum asymmetric angle $\alpha_0$ is approximately 19.7°.

More preferably, the micrometer-service crystal is made of a silicon after cut at the maximum asymmetric angle $\alpha_0$ from a plane (111).

According to the present invention, a method of manufacturing a monochromator having an asymmetric cut curved-surface as a reflecting surface, comprises the steps of:

cutting a cylindrical body having a center axial line at a maximum asymmetric angle $\alpha_0$ with respect to a plane orthogonal to the center axial line to obtain an ellipsoidal asymmetric cut surface;

shaping the thus obtained ellipsoidal asymmetric cut surface along a peripheral surface of an imaginary cylindrical body having a radius $R_0$ to obtain an asymmetric cut curved-surface; and bonding a monochromator crystal to the asymmetric cut curved-surface;

wherein said step of determining the asymmetric angle $\alpha_0$ includes the following steps of:

determining an asymmetric factor b defined by an equation of b=L/F, where L is a distance between an X-ray source and the monochromator crystal, and F is a distance between the monochromator crystal and a focusing point;

determining a wavelength range to be used;

determining a monochromator crystal and a reflecting surface thereof;

determining a maximum angle of diffraction $\theta_{max}$ of the monochromator crystal corresponding to a longest wavelength $\lambda_{max}$ within the wavelength range, according to the Bragg equation; and determining an asymmetric angle $\alpha_{max}$ corresponding to the maximum angle of diffraction $\theta_{max}$ by a following equation:

$$b=\sin(\theta+\alpha)/\sin(\theta-\alpha)=L/F$$

where $\theta$ is an angle of diffraction of the monochromator crystal, and $\alpha$ is an asymmetric angle, and then determining the maximum angle of diffraction $\theta_{max}$ based on the thus determined maximum angle of diffraction $\alpha_{max}$.

In a preferable embodiment of the method according to the invention, the step of shaping the ellipsoidal asymmetric cut surface along the peripheral surface of the imaginary cylindrical body having the radius $R_0$, comprises the steps of:

determining a minimum radius $R_{min}$ of the imaginary cylindrical body corresponding to the longest wavelength $\lambda_{max}$ by a following equation:

$$2/R=[\sin(\theta+\alpha)]/L+[\sin(\theta-\alpha)]/F$$

where R is a radius of the imaginary cylindrical body, and then determining a radius $R_0$ of the imaginary cylindrical body based on the thus determined minimum radius $R_{min}$;

obtaining an offset angle $\beta$ according to a difference between an azimuth angle $\phi_a$ corresponding to an ideal asymmetric angle $\alpha$, and an azimuth angle $\theta_R$ corresponding to a radius R of an ideal imaginary cylindrical body, and curving the ellipsoidal asymmetric cut surface using the radius $R_0$ of the imaginary cylindrical body and the offset angle $\beta$.

DETAILED EXPLANATION OF THE PREFERRED EMBODIMENTS

Figure 1:
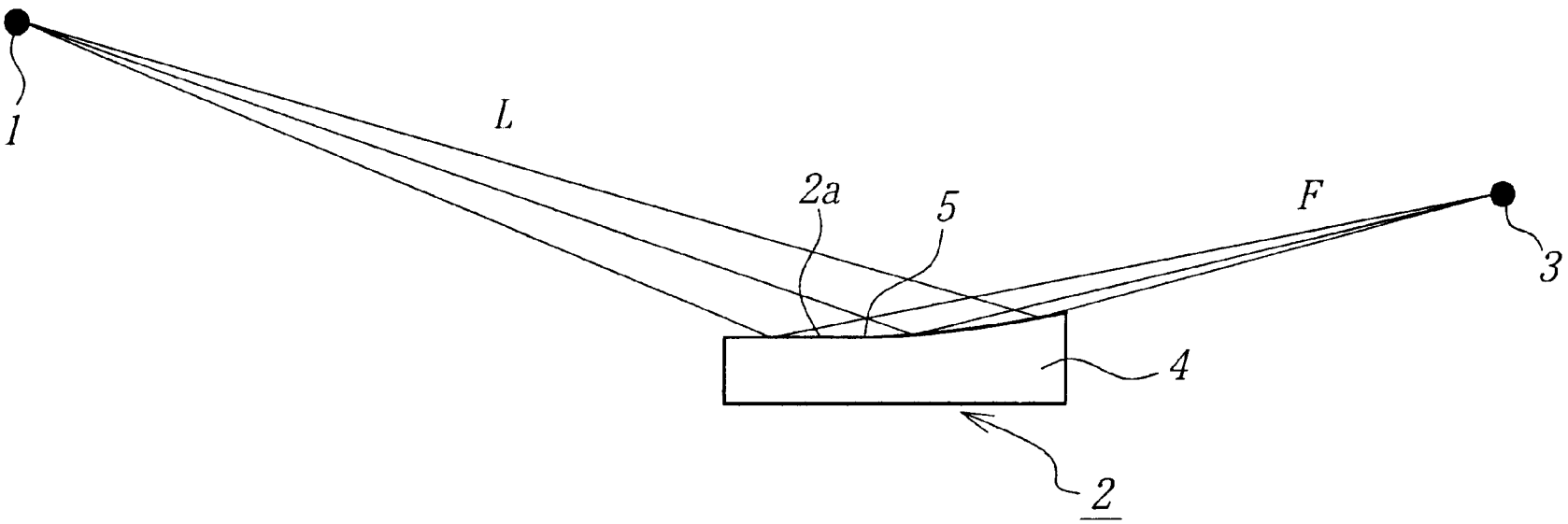
FIG. 1 is a schematic view showing an arrangement of an embodiment of the X-ray monochromator according to the present invention.

FIG. 1 is a schematic view showing an embodiment of the X-ray monochromator according to the present invention. An X-ray beam radiated from an X-ray source 1 is directed to a monochromator (spectrometer) 2 according to the present invention. A reflecting surface 2*a* of the monochromator 2 is shaped into a cylinder-like curved surface which converts the incident X-ray beam into a converging beam and then focuses the beam onto a focusing point 3.

The monochromator 2 comprises a base member, i.e. a pedestal 4 made of, for example, copper, and a monochromator silicon crystal 5 bonded to a cylinder-like curved surface of the pedestal 4. This monochromator silicon crystal 5 is shaped to have a focusing surface which serves to focus the incident X-ray beam onto the focusing point 3. The curved surface of the pedestal 4 made of copper is processed by the hyperfine processing technique. The monochromator silicon crystal 5 is formed by a silicon wafer of 1 mm thickness which is obtained by cutting a five-inch ingot. The cutting is effected with an asymmetric angle of 19.7° with respect to a (111) plane and the thus cut surface is finished by mechano-chemical polishing. The monochromator silicon crystal 5 is bonded to the curved surface so as to fit thereto using a mineral oil. Instead of the surface tension of the mineral oil, the diffusion-bonding method and the electrostatic bonding method may be utilized for securing the silicon crystal 5 to the curved surface of the pedestal 4.

Now a principle in designing the monochromator according to the present invention will be described. In the present invention, in order to tune two parameters, i.e. an asymmetric angle a and a radius of curvature Ra simultaneously, use is made of a tilted-surface focusing monochromator whose surface has been curved along a peripheral surface of a cylindrical body to have a focusing capability.

Figure 2:
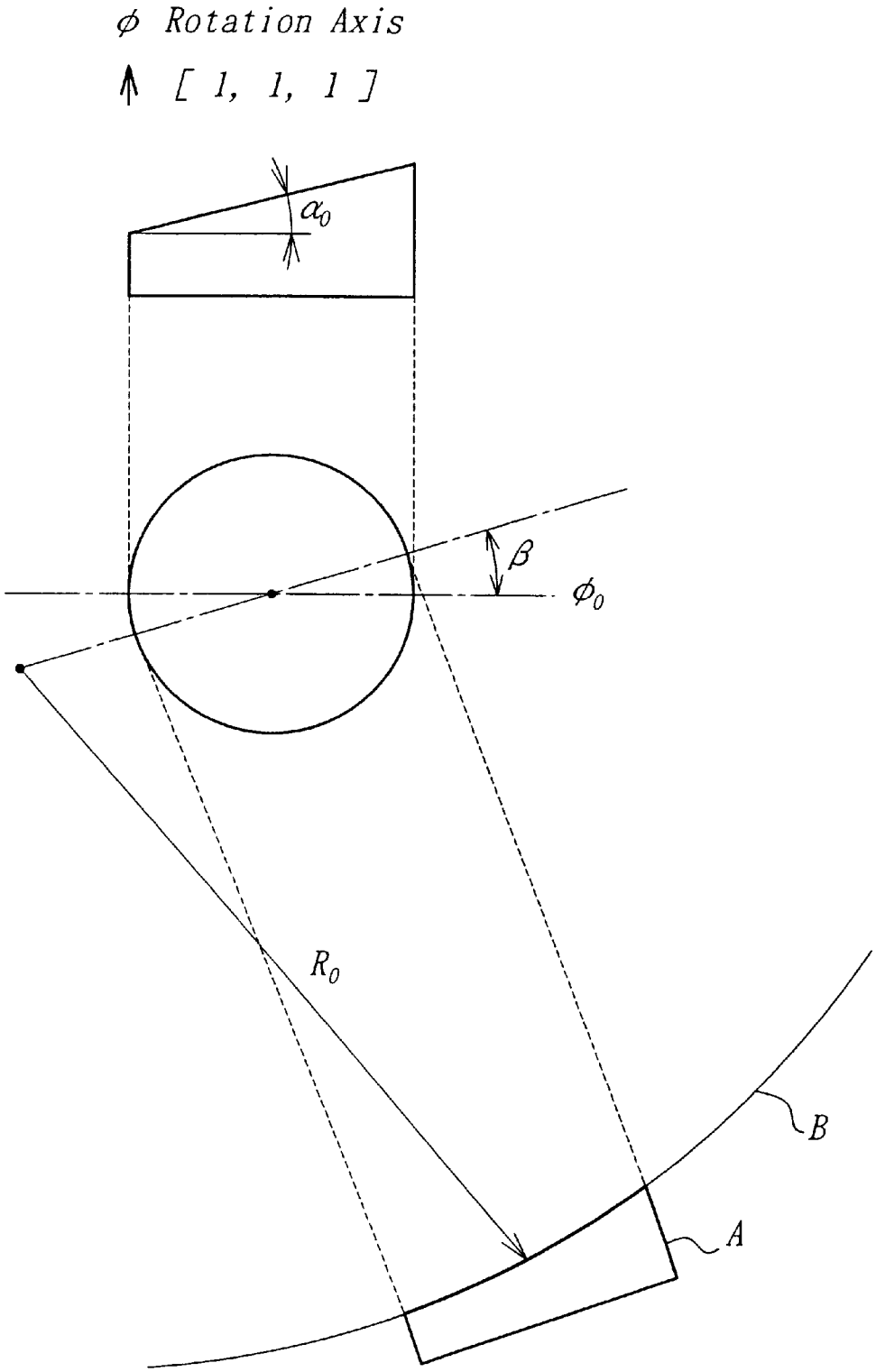
FIG. 2 is a schematic view explaining the design principles of the monochromator according to the present invention.
Figure 3:
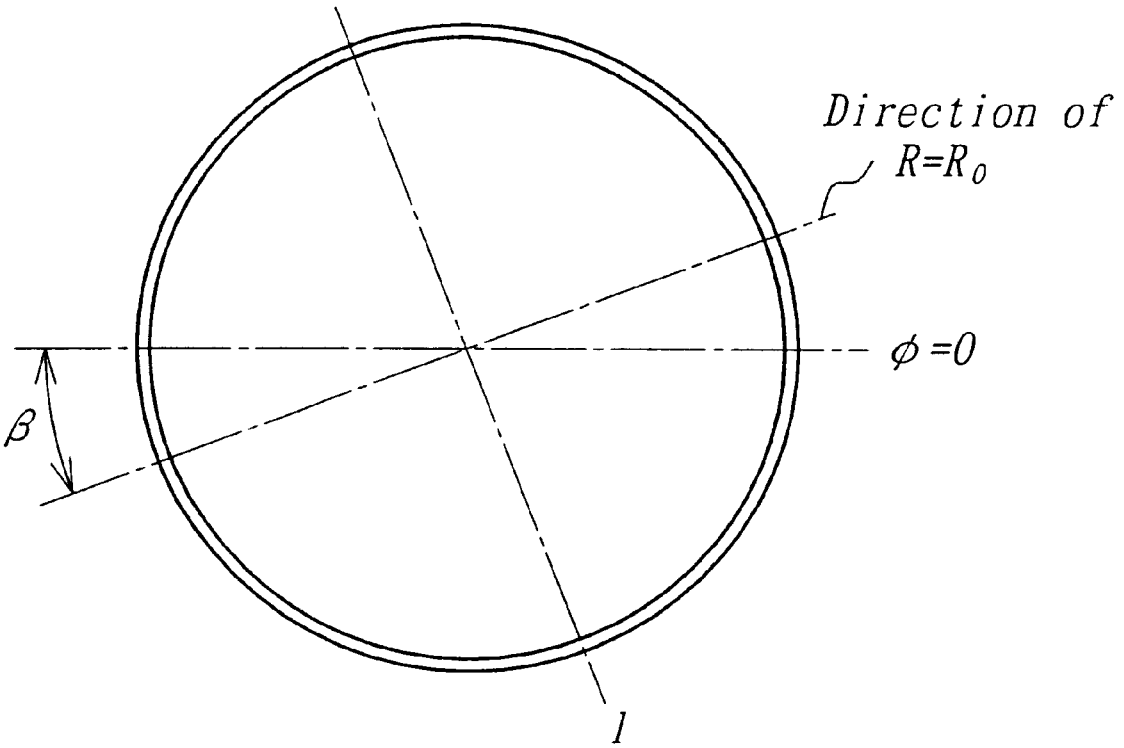
FIG. 3 is a schematic view explaining the design principles of the monochromator according to the present invention, showing the relationship between a $\phi$-rotation axis and parameters of the monochromator.
Figure 3:
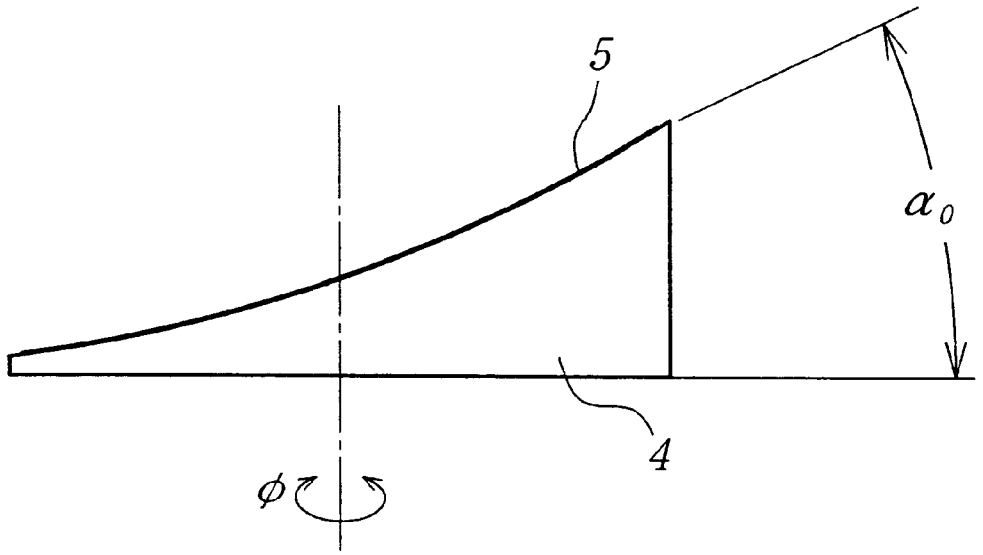

FIGS. 2 and 3 are diagrams explaining a principal method of designing the monochromator according to the present invention. A cylindrical body A made of, for example, copper is first prepared. This cylindrical body A is then cut at a maximum asymmetric angle $\alpha_0$ with respect to a plane orthogonal to an center axis of the cylindrical body. In concrete terms, the maximum asymmetric angle $\alpha_0$ means an angle which is 2 to 5 degrees lager than a maximum angle of an asymmetric angel a between the Bragg plane and a crystal plane. An optical system has to be located on the Rowland circle, and for this purpose an equation of b=L/F (FIG. 1) should be satisfied. It is now assumed that b=16.7. Moreover, it is most desirable that an asymmetric factor b representing a change in a ratio of an outgoing X-ray beam to an incident X-ray beam as shown by the following equation (1) is identical with the above mentioned value.

$$b=\sin(\theta+\alpha)/\sin(\theta-\alpha) \quad (1)$$

where $\theta$ is an angle of diffraction due to a (111) silicon crystal. For example, in a case of designing a monochromator which covers a wavelength range having a longest wavelength of 2.40 Å, $\alpha$ has a maximum value at the wavelength of 2.40 Å and thus when $\alpha$=20.16°, the value b defined by the above equation (1) becomes 17.6. Therefore, the maximum asymmetric angle $\alpha_0$ can be set to 22.0° which is slightly larger than the above value of $\alpha$=20.16°.

Next, the asymmetric cut surface is shaped along a peripheral surface of an imaginary cylindrical body B having a radius $R_0$. Moreover, an azimuth angle around the center axial line of the cylindrical body A is defined by $\phi$, a direction in which a tilt angle of the focusing tilted-surface becomes maximum (a direction of a major axis of an ellipsoid formed by cutting the cylindrical body A at the maximum asymmetric angle $\alpha_0$) is defined by $\phi_0$, and the origin of the azimuth angle ($\phi$=0) is defined as this direction ($\phi_0$). Also, the center axial line 1 of the imaginary cylindrical body B (see FIG. 3) is perpendicular to the center axial line of the cylindrical body A and is set to an angle of 90°-β with respect to the axial line shown by $\phi=0$ (corresponding to the major axis of the ellipsoidal asymmetric cut surface) as viewed from the above in a direction of the center axial line of the cylindrical body A. This state can be understood from an upper part of FIG. 3. The above angle β is referred to as an offset angle, which is required to simultaneously tune, by only the φ-axis rotation, two parameters of the asymmetric angle α and the radius of curvature R of the asymmetric curved surface.

Figure 4:
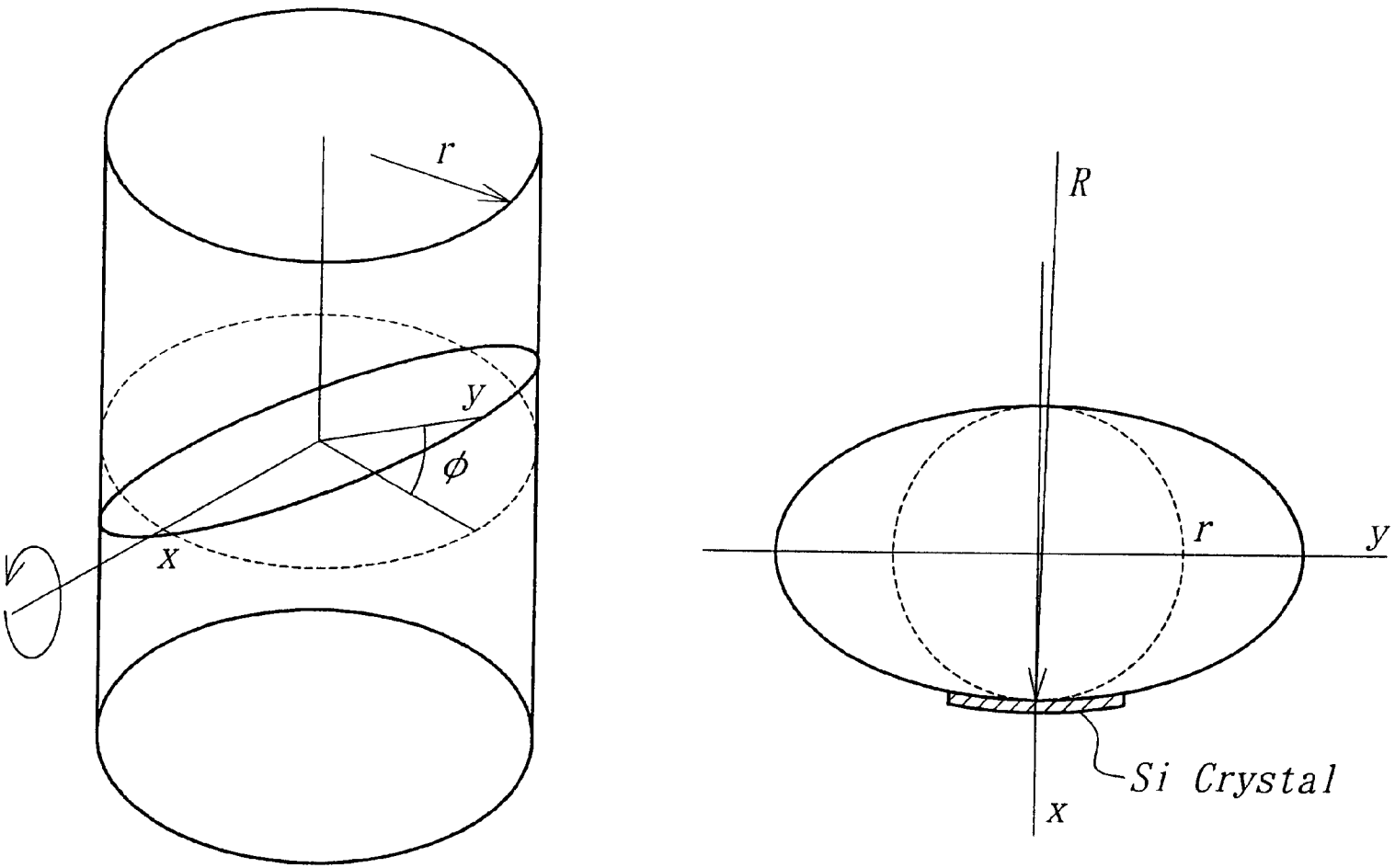
FIG. 4 is a schematic diagram explaining the design principles of the monochromator according to the present invention, showing the relationship between an azimuth $\phi$ and a radius of curvature R.
Figure 5:
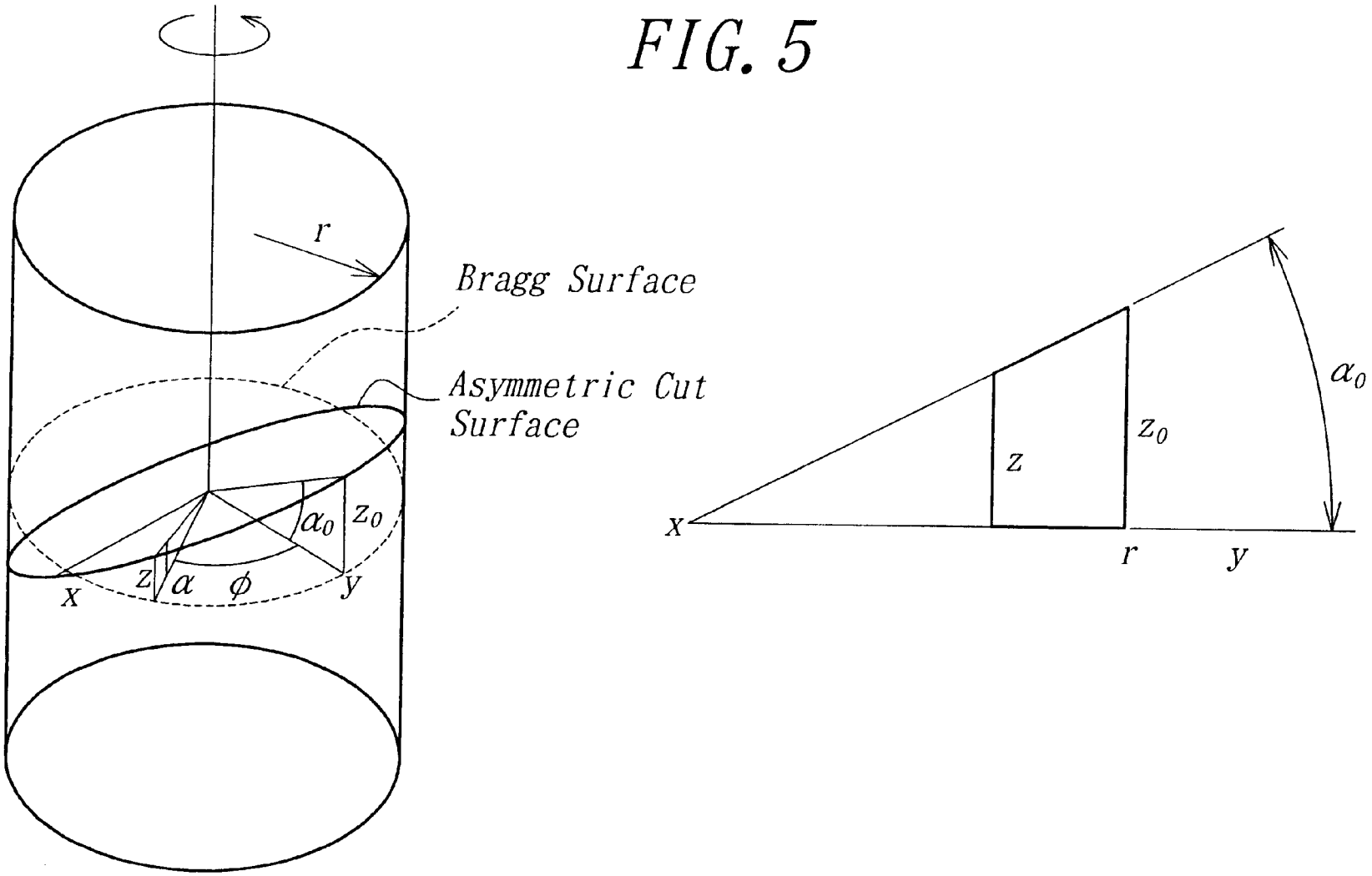
FIG. 5 is a schematic view explaining the design principles of the monochromator according to the present invention, showing the relationship between an azimuth $\phi$ and an asymmetric angle $\alpha$.

The radius of curvature R of the asymmetric cut curved-surface can be calculated as follows:

When the cylindrical body A having a radius r is, as shown in FIG. 4, cut at an angle φ with respect to a plane orthogonal to the center axial line thereof, the cut surface has ellipsoidal shape which may be expressed by the following equation (2):

$$X^2+y^2\cos^2\phi=r^2 \quad (2)$$

Further, the radius of curvature R is given by the following equation (3):

$$R=(1+(dx/dy)^2)^{3/2}/(d^2X/dy^2) \quad (3)$$

The ellipsoidal crystal plane has, as viewed from the x-axis in FIG. 4, a radius of curvature R. Therefore, when the offset angle β is set as shown in FIGS. 2 and 3, the radius of curvature R is defined by the following equation (4):

$$R=R_0/\cos^2(\phi-\beta) \quad (4)$$

Besides, the asymmetric angle α exhibited at the angle φ may be determined as follows:

An axial distance Z with respect to a plane tilted by the angle $\alpha_0$ with respect to an x-y plane orthogonal to the center axis line of the imaginary cylindrical body B having the radius $R_0$ is defined by the following equation:

$$Z=r\cdot\cos\phi\cdot\tan_0 \quad (5)$$

Therefore, a relationship between the azimuth angle φ and the asymmetric angle α may be represented by the following equation (6):

$$\tan\alpha=\tan\alpha_0\times\cos\phi \quad (6)$$

The optimum value of the asymmetric angle α can be obtained by substituting 16.7 for the asymmetric factor b in the above-mentioned equation (1). On this occasion, the azimuth angle φ used for obtaining the above a value on the monochromator can be calculated by the use of the equation (6), and then the radius of curvature R corresponding to this φ value can be obtained by the use of the equation (4).

A relationship between the radius of curvature R of the curved surface, and a distance L between the X-ray source and the monochromator crystal as well as a distance F between the monochromator crystal and the focusing point distance is given by the following equation (7):

$$2/R=[\sin(\theta+\alpha)]/L+[\sin(\theta-\alpha)]/F \quad (7)$$

where θ is an angle of reflection on the monochromator.

The offset angle β is determined, based on the above-mentioned relationship, in such a manner that the asymmetric angle α and the radius of curvature R become most suitable for a desired wavelength.

Finally, to the asymmetric cut cylindrically curved-surface of the cylindrical body A is bonded the monochromator crystal 5 cut at the asymmetric angle $\alpha_0$. In this case, the monochromator crystal 5 is bonded such that the direction showing the asymmetric angle $\alpha_0$ of the crystal is coincided with the azimuth angle $\phi_0$.

In this manner, in the monochromator according to the present invention, the axis of the reflecting surface can be coincided with the φ axis, the asymmetric angle α can be changed in accordance with the equation (6) by the rotation about the φ axis and the radius of curvature R of the focusing curved surface can be changed in accordance with the equation (4). Therefore, a wide wavelength ranged can be covered by only one monochromator crystal. Further, since the monochromator crystal is fixed to the pedestal, a cooling water may be circulated through the pedestal to mitigate the problem of thermal load to a large extent.

Next an algorithm of designing the monochromator according to the present invention will be described hereinbelow while exemplifying a case in which the X-ray monochromator according to the present invention is used for radiation light experimental facility BL6B station. Conditions for designing may be given as follows:

A monochromator-service crystal: Si (111)(D=3.136 Å)

A distance L between an X-ray source and a monochromator crystal: L=23 m

A distance F between a monochromator crystal and a focusing point (focusing distance) F: F=1.38 m A condition of locating the crystal on the Rowland circle: b=23 m/1.38 m=16.7

Step 1

To determine a value of the asymmetric factor b by substituting the distance L between the X-ray source and the monochromator crystal and the distance F between the monochromator crystal and the focusing point for the equation of b=L/F. For example, if L=23 m and F=1.38 m, b=16.7 is obtained.

Step 2

To determine a wavelength range to be used. This wavelength range may be set to, for example, 0.87 to 1.9 Å.

Step 3

To determine a crystal to be used for the monochromator and its reflecting surface. When the reflecting surface is determined as, for example, a plane (111), a spacing $d_{111}$ is 3.136 Å.

Step 4

Next, to determine a maximum angle of diffraction of the monochromator crystal corresponding to the longest wavelength $\lambda_{max}$ within the given wavelength range to be used. In concrete terms, to calculate a value of θ corresponding to the longest wavelength $\lambda_{max}$ within the given wavelength range by the use of the Bragg equation, i.e. $2d\cdot\sin\theta=n\lambda$. Moreover, in the above Bragg equation, n is set to 1. For example, when substituting 1.9 Å for the longest wavelength in the Bragg equation with the reflecting surface set to the plane (111) of silicon, the Bragg equation may be rewritten as follows:

$$2\times3.136\sin\theta_{max}=1.9\ \text{Å}$$

Therefore, $\theta_{max}$ is 17.63°.

Step 5

To determine a maximum asymmetric angle $\alpha_0$. The following equation is obtained based on the equation (1).

$$b=\mathrm{Sin}(\beta+\alpha)/\sin(\beta-\alpha)=L/F$$

The corresponding $\alpha_{max}$ value is obtained as 17.54° by substituting $\theta_{max}$=17.63 for the above equation. This $\alpha_{max}$ value can also be determined as the maximum asymmetric angle $\alpha_0$ which is, taking account of design margin, made larger slightly. To this end, for example, the $\alpha_0$ value is 19.7.

Step 6

Next, to determine the radius $R_0$ of the imaginary cylindrical body B used when the reflecting surface is shaped like a cylinder. The relationship between the wavelength X and the radius R of the imaginary cylindrical body B is calculated by the use of the equation (7). Because the longest wavelength $\lambda_{max}$ within the wavelength range to be used corresponds to the shortest radius $R_{max}$ of the imaginary cylindrical body B, the shortest radius $R_{max}$ may be obtained by the use of the equation (7) which is rewritten as follows:

$$2/R_{min}=[\sin(\theta+\alpha)]/L+[\sin(\theta-\alpha)]/F$$

On this occasion, the numerical calculation is carried out assumed that $\beta=17.63°$, $\alpha=15.74°$, L=23 m, F=1.38 m, which provides, in turn, $R_{min}=41.72$ m. On the other hand, in measurement, the θ axis is rotated to change the wavelength, and when an amount of the ϕ axis rotation is increased, the radius of curvature of the reflecting surface of the monochromator becomes larger. Therefore, the minimum radius of the imaginary cylindrical body B obtained when forming the reflecting surface must be $R_{min}$ or less than $R_{min}$. In this example, the minimum radius is made shorter than $R_{min}$ by 3 m; therefore, $R_0$ is 38.7 m.

Step 7

Further, to obtain the offset angle β. An ideal asymmetric angle α can be obtained by the use of the equation (1), and further the azimuth angle α corresponding to the ideal value of α can be obtained by the equation (6). Therefore, the value of ϕ obtained by the equation (6) is an ideal value, this value of ϕ is defined as $\phi_0$. On the other hand, the ideal value of R can be obtained by the equation (7), and the value $\phi_R$ required to obtain the ideal R can be obtained by the equation (4). Then, the difference between $\phi_0$ and $\phi_R$ represents the offset angle β. On the other hand, since β is changed according to wavelengths, an average value of β within the given wavelength range is set as the value of β. The calculation examples are given as under.

(a) To obtain a relationship between ϕ and α.

The values of λ, β and α may be obtained based on the above-mentioned calculation example.

The above equation (6) may be rewritten into $\cos\phi_0=\tan\alpha/\tan\alpha_0$. When substituting thus obtained numerals for this equation, $\alpha_0$ is 19.7°; then, the equation may be rewritten as follows:

$$\cos\phi_0=\tan\alpha/0.3581$$

The results obtained by the above numeral calculations for respective wavelengths are shown in Table 1.

TABLE 1

| λ(Å) | θ(deg) | α(deg) | $\phi_0$(deg) |
|---|---|---|---|
| 1.0 | 9.17 | 8.15 | 66.43 |
| 1.2 | 11.03 | 9.81 | 61.13 |
| 1.4 | 12.89 | 11.47 | 55.49 |
| 1.6 | 14.77 | 13.17 | 49.20 |
| 1.8 | 16.67 | 14.88 | 42.10 |
| 1.9 | 17.63 | 15.74 | 38.09 |

(b) Next, to calculate the ideal value of R by the use of the equation (7). In this case, substituting L=23 m, F=1.38 m as well as the values of θ and α in the above Table 1 for the equation (7).

Further, the value of $\phi_R$ for obtaining the ideal value of R is obtained by substituting $R_0=38.4$ m for the equation of $R=R_0/\cos^2\phi_R(\phi_R=\phi-\beta)$ derived from the equation (4); then $$\cos^2\phi_R=38.7/R$$

is obtained.

The value ϕ in the equation of $\phi_R=\phi-\beta$ is actually $\phi_a$, and thus the equation of $\beta=\phi_a-\phi_R$ may be derived. The deviation of β for ϕ represents an error. The results obtained by carrying out the above-mentioned numeral calculations are added to Table 1, which is shown in the following Table 2.

TABLE 2

| λ(A) | θ(deg) | α(deg) | $\phi_a$(deg) | R(m) | $\phi_R$(deg) | β(deg) | Δβ(deg) |
|---|---|---|---|---|---|---|---|
| 1.0 | 9.17 | 8.15 | 66.43 | 77.39 | 45.00 | 21.43 | −0.37 |
| 1.2 | 11.03 | 9.81 | 61.13 | 64.73 | 39.36 | 21.94 | 0.14 |
| 1.4 | 12.89 | 11.47 | 55.49 | 55.73 | 33.56 | 21.93 | 0.13 |
| 1.6 | 14.77 | 13.17 | 49.20 | 49.26 | 27.58 | 21.62 | −0.18 |
| 1.8 | 16.67 | 14.88 | 42.10 | 44.07 | 20.43 | 21.67 | −0.13 |
| 1.9 | 17.63 | 15.74 | 38.09 | 41.83 | 15.88 | 22.21 | 0.41 |

According to the calculated values in the Table 2, an average value of β is 21.8°; therefore, the value of β may be determined to be 21.8°. Moreover, Δβ in the Table 2 represents a deviation from the average value; therefore, $\Delta\beta=\beta-21.8$ holds. By precisely selecting the values of $R_0$, $\alpha_0$ and β using the least squares method, the accuracy can be improved. Making the above example precise by the least squares method provides the following results:

$$\alpha_0=19.7°,\ R_0=37.9\text{ m},\ \beta=20.9°$$

Next, a monochromator was actually designed and manufactured in accordance with the above-mentioned design conditions, and then performance experiments were carried out. The results will be described below. The actual test was carried out for three wavelengths of 1.04, 1.38, and 174 Å which cover a wavelength range required for the heavy atom isomorphism substitution method. The respective wavelengths are absorption edges of Au, Cu, Fe. Table 3 shows parameters of the monochromator for each of the wavelengths. In actual, the wavelength was first determined by the Bragg plane rotation, and then the focusing was carried out while simultaneously optimizing the asymmetric angle ox and the radius of curvature R by the ϕ-axis rotation.

TABLE 3

| λ(Å) | α(deg) | ϕ(deg) | R(m) | Ropt(m) | ϵ(%) |
|---|---|---|---|---|---|
| 1.07 | 8.73 | 64.6 | 72.5 | 72.3 | 0.28 |
| 1.38 | 11.3 | 56.0 | 56.7 | 56.5 | 0.35 |
| 1.74 | 14.4 | 44.3 | 45.0 | 45.4 | 0.88 |

$R_{opt}$ is an ideal radius, and ϵ represents $|R—R_{opt}|/R_{opt}$.

Figure 6:
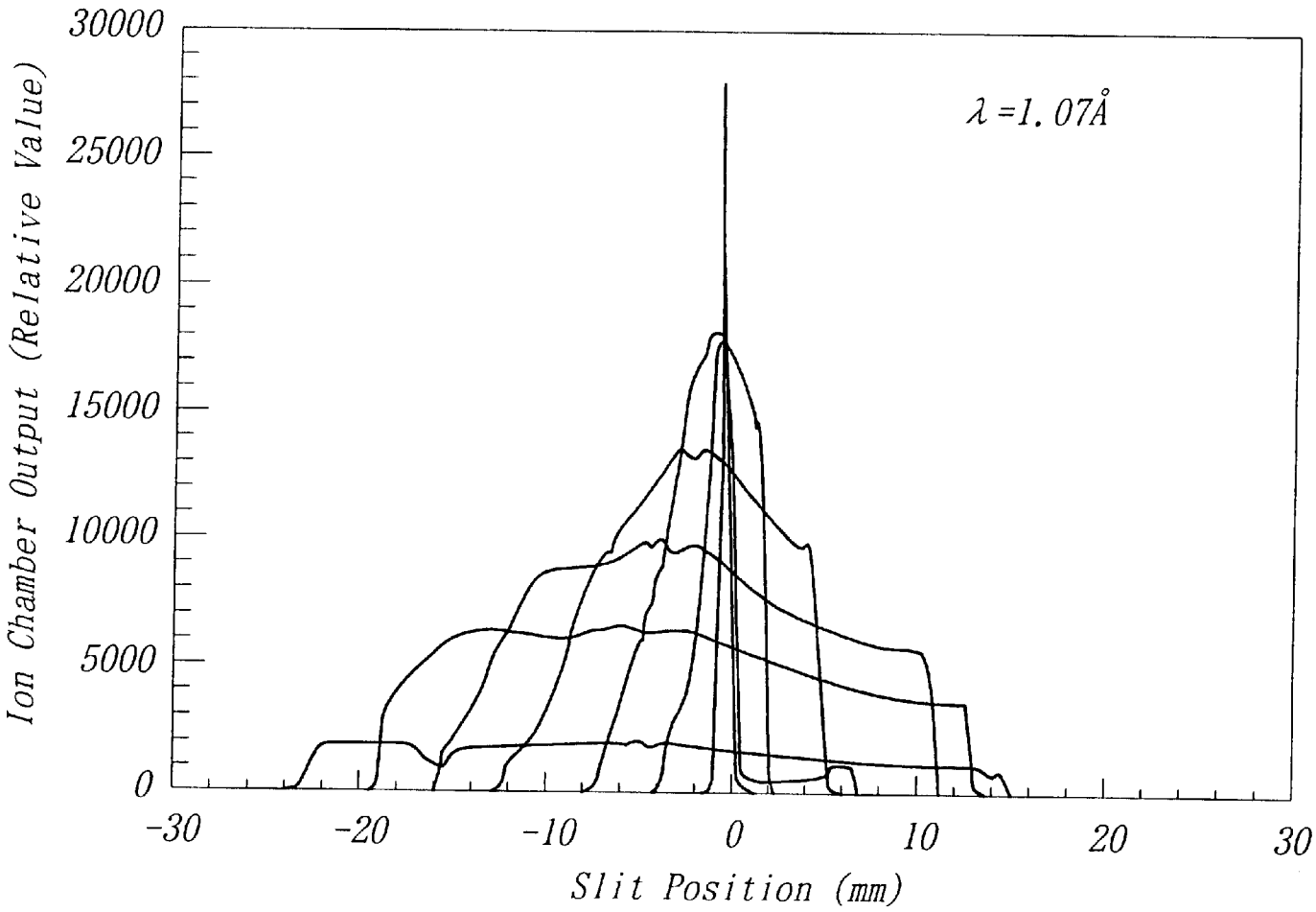
FIG. 6 is a graph showing a focusing state at which a wavelength is 1.07 Å.
Figure 7:
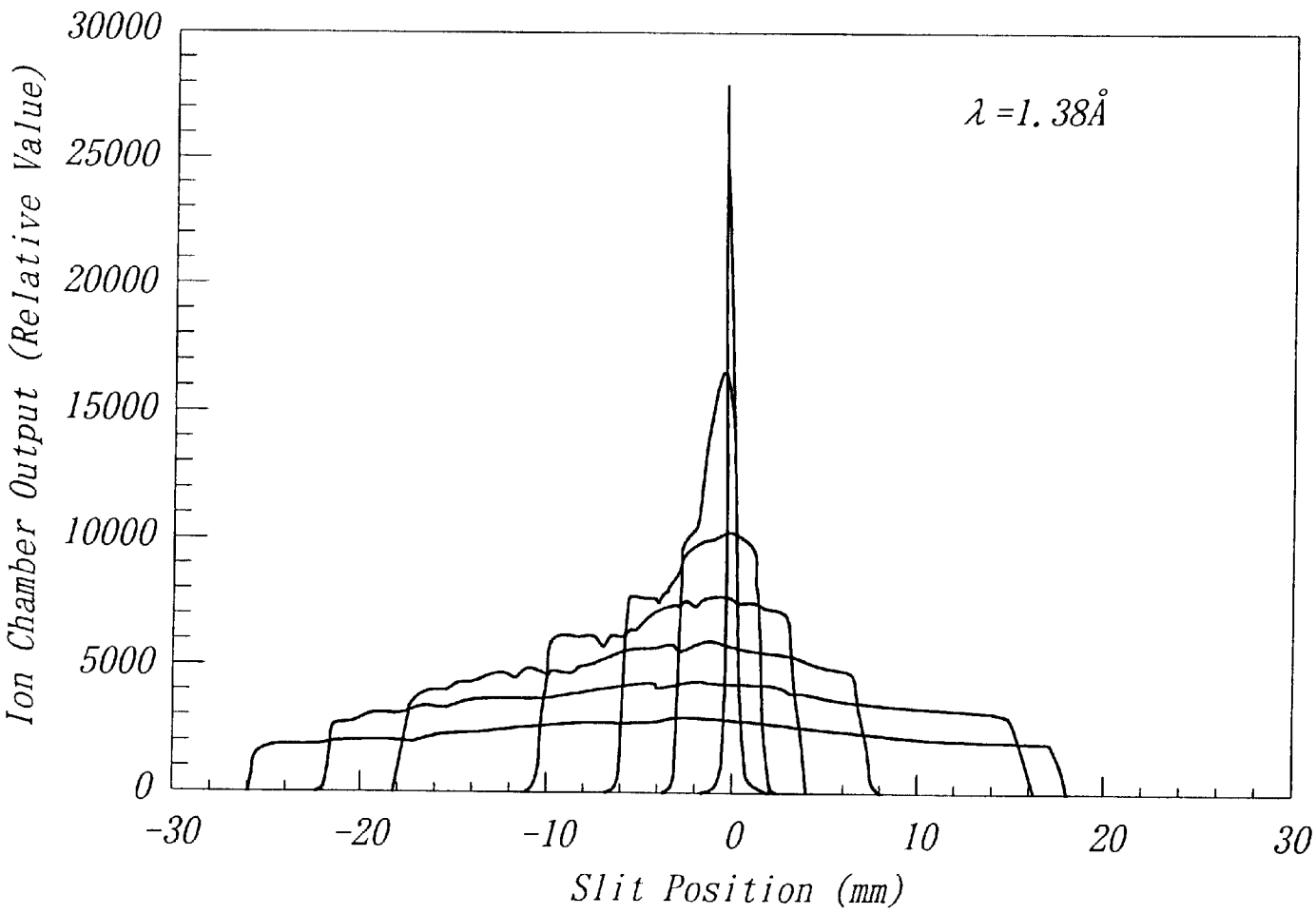
FIG. 7 is a graph showing a focusing state at which a wavelength is 1.38 Å.
Figure 8:
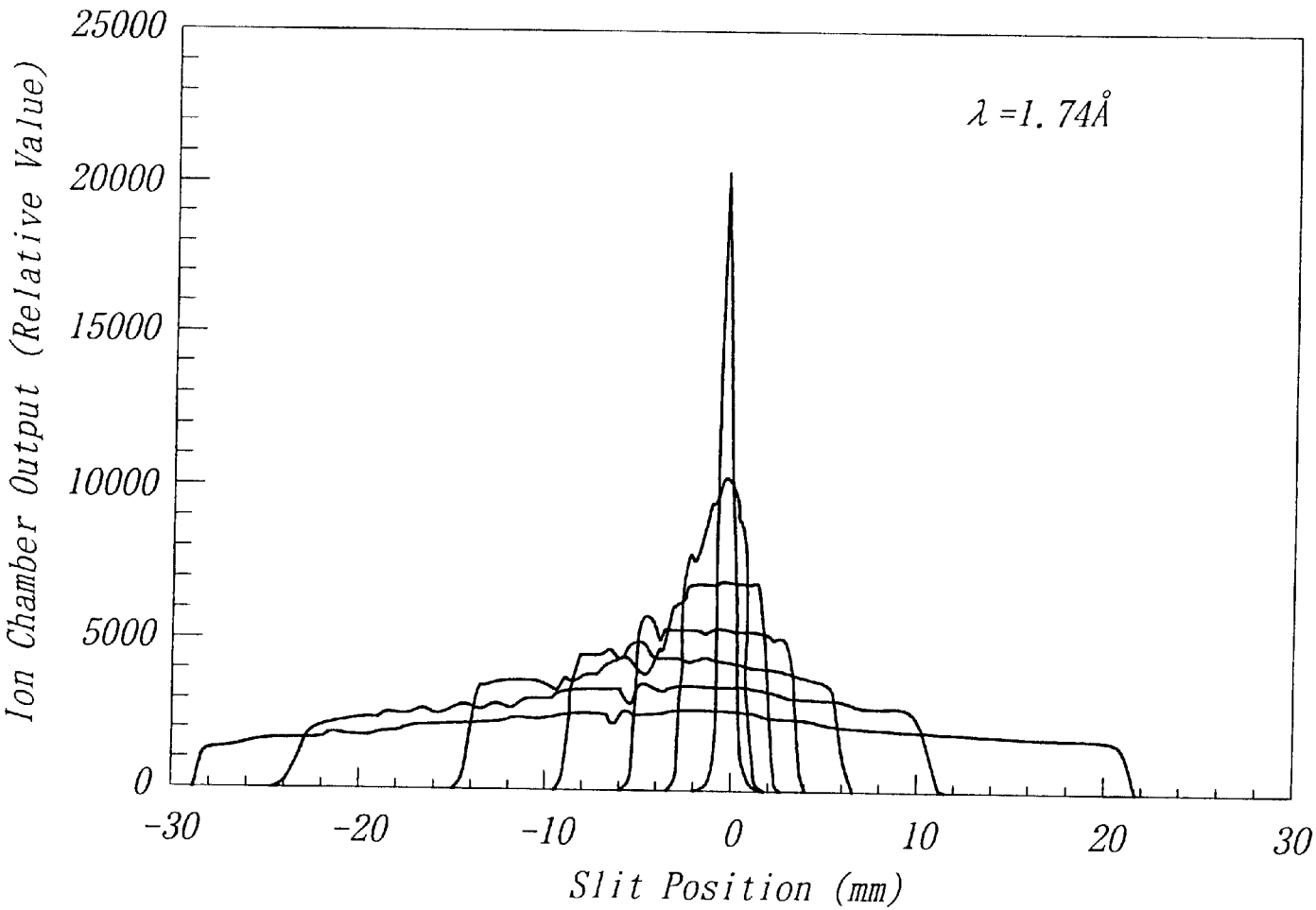
FIG. 8 is a graph showing a focusing state at which a wavelength is 1.74 Å.

To verify the shape of the beam at the focusing point, experimental results obtained by scanning a slit of 0.2 mm in the horizontal plane for respective wavelengths are shown in FIGS. 6 to 8. FIGS. 6 to 8 reveal that the monochromator according to the present invention can generate well compressed and focussed beam at respective wavelengths with only one ϕ-axis rotation just as designed.

What is claimed is:

1. A monochromator comprising:

a base member having an asymmetric cut curved-surface obtained by cutting a cylindrical body at a maximum asymmetric angle $\alpha_0$ with respect to a plane orthogonal to a center axial line of the cylindrical body to obtain an ellipsoidal asymmetric cut surface, and then curving the thus obtained ellipsoidal asymmetric cut surface; and a monochromator crystal bonded to said asymmetric cut curved-surface of the base member;

wherein said asymmetric cut curved-surface of the base member is shaped along a peripheral surface of an imaginary cylindrical body having a radius $R_0$, and an asymmetric angle and a radius of curvature for a desired wavelength are simultaneously tuned by rotating said base member around a center axial line thereof.

2. A monochromator as claimed in claim 1, wherein said imaginary cylindrical body has a center axial line which intersects with said center axial line of said base member, and said center axial line of the imaginary cylindrical body makes an angle of 90°-β with respect to a major axis of said ellipsoidal asymmetric cut surface where β is an offset angle ranging from 0 to 90° viewed from above said center axial line of said base member.

3. A monochromator as claimed in claim 2, wherein said offset angle β is approximately 20.9°.

4. A monochromator as claimed in claim 2, wherein said maximum asymmetric angle $\alpha_0$ approximately 19.7°.

5. A monochromator as claimed in claim 2, wherein said micrometer is formed by a silicon wafer cut at said maximum asymmetric angle $\alpha_0$ from a plane (111).

6. A monochromator as claimed in claim 1, wherein said base member is provided with cooling means for preventing temperature rise of said monochromator.

7. A method of manufacturing a monochromator having an asymmetric cut curved-surface as a reflecting surface, comprising the steps of:

cutting a cylindrical body having a center axial line at a maximum asymmetric angle $\alpha_0$ with respect to a plane orthogonal to the center axial line to obtain an ellipsoidal asymmetric cut surface;

shaping the thus obtained ellipsoidal asymmetric cut surface along a peripheral surface of an imaginary cylindrical body having a radius $R_0$ to obtain an asymmetric cut curved-surface; and bonding a monochromator crystal to the asymmetric cut curved-surface; wherein said step of determining the asymmetric angle $\alpha_0$ includes the following steps of:

determining an asymmetric factor b defined by an equation of b=L/F, where L is a distance between an X-ray source and the monochromator crystal, and F is a distance between the monochromator crystal and a focusing point;

determining a wavelength range to be used;

determining a monochromator crystal and a reflecting surface thereof;

determining a maximum angle of diffraction $\theta_{max}$ of the monochromator crystal corresponding to a longest wavelength $\lambda_{max}$ within the wavelength range, according to the Bragg equation; and determining an asymmetric angle $\alpha_{max}$ corresponding to the maximum angle of diffraction $\theta_{max}$ by a following equation:

$$b=\sin(\theta+\alpha)/\sin(\theta-\alpha)=L/F$$

where θ is an angle of diffraction of the monochromator crystal, and α is an asymmetric angle, and then determining the maximum angle of diffraction $\theta_{max}$ based on the thus determined maximum angle of diffraction $\alpha_{max}$.

8. A method of producing a monochromator, as claimed in claim 7, wherein said step of shaping said ellipsoidal asymmetric cut surface along said periphery of said imaginary cylindrical body having said radius $R_0$, comprises the steps of:

determining a minimum radius $R_{min}$ of the imaginary cylindrical body corresponding to the longest wavelength $\lambda_{max}$ by a following equation:

$$2/R=[\sin(\theta+\alpha)]/L+[\sin(\theta-\alpha)]/F$$

where R is a radius of the imaginary cylindrical body, and then determining a radius $R_0$ of the imaginary cylindrical body based on the thus determined minimum radius $R_{min}$;

obtaining an offset angle β according to a difference between an azimuth angle $\phi_a$ corresponding to an ideal asymmetric angle α, and an azimuth angle $\theta_R$ corresponding to a radius R of an ideal imaginary cylindrical body, and curving the ellipsoidal asymmetric cut surface using the radius $R_0$ of the imaginary cylindrical body and the offset angle β.

* * * * *